US012156562B2

(12) United States Patent
Worple et al.

(10) Patent No.: US 12,156,562 B2
(45) Date of Patent: Dec. 3, 2024

(54) HARD HAT WITH IMPACT PROTECTION MATERIAL

(71) Applicant: Milwaukee Electric Tool Corporation, Brookfield, WI (US)

(72) Inventors: Joseph R. Worple, Menomonee Falls, WI (US); Abhijeet A. Khangar, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 519 days.

(21) Appl. No.: 17/330,123

(22) Filed: May 25, 2021

(65) Prior Publication Data

US 2021/0352992 A1 Nov. 18, 2021

Related U.S. Application Data

(63) Continuation of application No. PCT/US2021/031810, filed on May 11, 2021.

(60) Provisional application No. 63/023,516, filed on May 12, 2020.

(51) Int. Cl.
*A42B 3/06* (2006.01)

(52) U.S. Cl.
CPC ..... *A42B 3/068* (2013.01); *A42B 3/064* (2013.01); *A42B 3/065* (2013.01)

(58) Field of Classification Search
CPC ..... A42B 3/068; A42B 3/064; A42B 3/065; A42B 3/128
See application file for complete search history.

(56) References Cited

U.S. PATENT DOCUMENTS

| | | | |
|---|---|---|---|
| 3,783,450 | A | 1/1974 | O'Connor |
| 4,006,496 | A | 2/1977 | Marker |
| 4,054,953 | A | 10/1977 | De Barsy |
| 4,075,717 | A | 2/1978 | Lemelson |
| 4,534,068 | A | 8/1985 | Mitchell et al. |
| 4,558,470 | A | 12/1985 | Mitchell et al. |
| 4,627,114 | A | 12/1986 | Mitchell |
| 5,309,576 | A | 5/1994 | Broersma |
| 5,343,569 | A | 9/1994 | Asare et al. |
| 5,345,614 | A | 9/1994 | Tanaka |
| 5,351,341 | A | 10/1994 | Broersma |
| 5,603,117 | A | 2/1997 | Hudner, Jr. et al. |
| 5,669,079 | A | 9/1997 | Morgan |

(Continued)

FOREIGN PATENT DOCUMENTS

| | | |
|---|---|---|
| EP | 3422887 | 11/2020 |
| WO | WO9614768 | 5/1996 |

(Continued)

OTHER PUBLICATIONS

International Search Report and Written Opinion for PCT/US2021/031810 dated Aug. 26, 2021, 9 pages.

(Continued)

*Primary Examiner* — Sally Haden
(74) *Attorney, Agent, or Firm* — Reinhart Boerner Van Deuren s.c.

(57) ABSTRACT

A hard hat and related impact protection layer is shown. The hard hat includes one or more feature to improve support of the impact protection layer. The impact protection layer is designed to improve impact energy absorption provided by a crushable material located within the hard hat shell.

12 Claims, 4 Drawing Sheets

(56) References Cited

U.S. PATENT DOCUMENTS 5,829,065 A 11/1998 Cahill
5,867,840 A 2/1999 Hirosawa et al.
5,943,706 A 8/1999 Miyajima et al.
5,950,244 A 9/1999 Fournier et al.
6,058,515 A 5/2000 Kitahara
6,070,271 A 6/2000 Williams
6,219,850 B1 4/2001 Halstead et al.
6,298,497 B1 10/2001 Chartrand
6,425,141 B1 7/2002 Ewing et al.
6,434,755 B1 8/2002 Halstead et al.
D466,651 S 12/2002 Halstead et al.
6,604,246 B1 8/2003 Obreja
6,865,752 B2 3/2005 Udelhofen et al.
6,925,657 B2 8/2005 Takahashi et al.
6,934,971 B2 8/2005 Ide et al.
7,036,151 B2 5/2006 Ide et al.
D528,705 S 9/2006 Ide et al.
7,146,652 B2 12/2006 Ide et al.
7,240,376 B2 7/2007 Ide et al.
7,464,414 B2 12/2008 McDuff
7,698,750 B2 4/2010 Bullock
7,774,866 B2 8/2010 Ferrara
7,802,320 B2 9/2010 Morgan
7,895,681 B2 3/2011 Ferrara
7,913,325 B2 3/2011 Bullock
7,930,771 B2 4/2011 Depreitere et al.
7,954,177 B2 6/2011 Ide et al.
8,060,951 B2 11/2011 Smith
8,117,679 B2 2/2012 Pierce
D670,868 S 11/2012 Harris
D670,869 S 11/2012 Harris
D670,870 S 11/2012 Harris
8,510,863 B2 * 8/2013 Ferguson ..... A41D 31/285 2/69
8,524,338 B2 9/2013 Anderson et al.
8,528,118 B2 9/2013 Ide et al.
8,528,119 B2 9/2013 Ferrara
8,640,267 B1 2/2014 Cohen
8,719,967 B2 5/2014 Milsom
8,776,272 B1 7/2014 Straus et al.
8,863,320 B2 10/2014 Kelly et al.
8,938,818 B2 1/2015 Ide et al.
8,955,169 B2 2/2015 Weber et al.
8,986,798 B2 3/2015 Anderson et al.
9,023,441 B2 5/2015 Anderson et al.
9,034,441 B2 5/2015 Anderson et al.
9,131,744 B2 9/2015 Erb et al.
9,314,060 B2 4/2016 Giles
9,326,561 B2 5/2016 Erb et al.
9,370,215 B1 6/2016 Straus et al.
9,474,318 B2 10/2016 Wesson et al.
9,572,390 B1 2/2017 Simpson
9,572,391 B2 2/2017 McInnis et al.
9,578,917 B2 2/2017 Cohen
9,603,408 B2 3/2017 Simpson
9,683,622 B2 6/2017 Ferrara
9,795,179 B2 10/2017 Lytle
9,820,522 B2 11/2017 Prabhu et al.
9,820,525 B2 11/2017 Weber et al.
9,833,032 B2 12/2017 Jacobsen
9,833,033 B2 12/2017 Erb et al.
9,907,347 B2 3/2018 Allen
9,961,952 B2 5/2018 Durocher
9,968,154 B2 5/2018 Tenenbaum et al.
9,986,779 B2 6/2018 Pritz et al.
10,010,127 B1 7/2018 Shaffer et al.
10,016,007 B2 7/2018 Jacobsen
10,039,338 B2 8/2018 Kelly et al.
10,098,404 B2 10/2018 Morgan
10,098,406 B2 10/2018 Erb et al.
10,136,692 B2 11/2018 Ide et al.
10,143,257 B2 12/2018 Ide et al.
10,143,258 B2 12/2018 Salmini et al.
10,201,743 B1 2/2019 Simpson
10,258,100 B1 4/2019 Erb et al.
10,271,603 B2 4/2019 Briggs
10,327,496 B2 6/2019 McGuckin, Jr.
10,342,280 B2 7/2019 Valentino, Sr. et al.
10,342,281 B2 7/2019 Fischer et al.
10,362,829 B2 7/2019 Lowe
10,376,009 B2 8/2019 Kennedy et al.
10,376,011 B2 8/2019 Erb et al.
10,413,009 B2 9/2019 McGuckin, Jr.
10,433,610 B2 10/2019 Lee
10,455,884 B2 10/2019 Wiart et al.
10,477,909 B2 11/2019 Laperriere et al.
10,531,698 B2 1/2020 Stolker
10,531,699 B2 1/2020 Kirshon
10,542,788 B2 1/2020 Simpson
10,561,189 B2 2/2020 Lee
10,561,192 B2 2/2020 Weber et al.
10,588,372 B2 3/2020 Ho
10,602,795 B2 3/2020 Allen et al.
10,645,989 B2 5/2020 Tenenbaum et al.
10,736,371 B2 8/2020 Lee
10,736,373 B2 8/2020 Chilson et al.
10,743,600 B2 8/2020 Cleveland et al.
10,757,995 B2 9/2020 Jacobsen
10,791,789 B2 10/2020 Creak et al.
10,806,201 B2 10/2020 Morgan
10,813,403 B2 10/2020 Vanhoutin et al.
10,842,216 B2 11/2020 Ganly
10,869,520 B1 12/2020 Leon
10,881,161 B2 1/2021 Jacobsen
10,932,514 B2 3/2021 Ide et al.
10,966,479 B2 4/2021 Browd et al.
10,980,306 B2 4/2021 Weber et al.
2002/0184699 A1 12/2002 Ewing et al.
2003/0140400 A1 7/2003 Ho
2006/0059605 A1 3/2006 Ferrara
2006/0059606 A1 3/2006 Ferrara
2007/0209098 A1 9/2007 Peart
2008/0155735 A1 7/2008 Ferrara
2008/0256686 A1 10/2008 Ferrara
2010/0000009 A1 1/2010 Morgan
2010/0167042 A1 7/2010 Ervasti
2010/0186150 A1 7/2010 Ferrara et al.
2010/0299813 A1 12/2010 Morgan
2011/0047685 A1 3/2011 Ferrara
2011/0107503 A1 5/2011 Morgan
2012/0036620 A1 2/2012 Harris
2012/0060251 A1 3/2012 Schimpf
2014/0033402 A1 2/2014 Salomon
2014/0123360 A1 5/2014 Cohen
2014/0223641 A1 8/2014 Henderson
2015/0113709 A1 4/2015 Cheng
2015/0164173 A1 6/2015 West
2015/0164174 A1 6/2015 West
2015/0223546 A1 8/2015 Cohen
2015/0223547 A1 8/2015 Wibby
2015/0250253 A1 9/2015 Jacobsen
2015/0305430 A1 10/2015 Rush et al.
2015/0359288 A1 12/2015 Woxing et al.
2016/0058092 A1 3/2016 Aldino et al.
2016/0295949 A1 10/2016 Giles
2017/0065017 A1 3/2017 Janson et al.
2017/0265556 A1 9/2017 Yang
2017/0273386 A1 9/2017 Kuo et al.
2018/0035739 A1 2/2018 Cohen et al.
2018/0049502 A1 2/2018 Wang
2018/0132557 A1 5/2018 Torres
2018/0199654 A1 7/2018 Allen
2018/0206580 A1 7/2018 Kennedy et al.
2018/0213875 A1 8/2018 Tutunaru
2018/0271201 A1 9/2018 Pritz et al.
2019/0000175 A1 1/2019 Shaffer et al.
2019/0014848 A1 1/2019 Tutunaru
2019/0090574 A1 3/2019 Shaffer
2019/0116911 A1 4/2019 Durocher
2019/0126127 A1 5/2019 Simpson
2019/0133235 A1 * 5/2019 Domanskis ..... A42B 3/0473
2019/0159541 A1 5/2019 Valentino
2019/0166947 A1 6/2019 Laperriere et al.
2019/0208853 A1 7/2019 Kelly et al.

(56) References Cited

U.S. PATENT DOCUMENTS

| | | | |
|---|---|---|---|
| 2019/0239590 | A1 | 8/2019 | Kennedy et al. |
| 2019/0254377 | A1 | 8/2019 | Briggs |
| 2019/0274389 | A1 | 9/2019 | McGuckin, Jr. |
| 2019/0297985 | A1 | 10/2019 | Weber et al. |
| 2019/0335838 | A1 | 11/2019 | Hoshizaki |
| 2019/0343211 | A1 | 11/2019 | Valentino, Sr. et al. |
| 2019/0350299 | A1 | 11/2019 | Lowe |
| 2019/0380419 | A1 | 12/2019 | Fischer et al. |
| 2020/0008509 | A1 | 1/2020 | McGuckin, Jr. |
| 2020/0008511 | A1 | 1/2020 | Wiart et al. |
| 2020/0085130 | A1 | 3/2020 | Beckman |
| 2020/0093215 | A1 | 3/2020 | Stolker |
| 2020/0163399 | A1 | 5/2020 | Tutunaru |
| 2020/0178637 | A1 | 6/2020 | Tenenbaum et al. |
| 2020/0187582 | A1 | 6/2020 | Laperriere et al. |
| 2020/0205502 | A1 | 7/2020 | Kirshon |
| 2020/0205503 | A1 | 7/2020 | Vanhoutin et al. |
| 2020/0240786 | A1 | 7/2020 | Josemans |
| 2020/0253314 | A1 | 8/2020 | Weber et al. |
| 2020/0305539 | A1 | 10/2020 | Beauchamp et al. |
| 2020/0329804 | A1 | 10/2020 | Allen et al. |
| 2020/0345096 | A1 | 11/2020 | Vanhoutin et al. |
| 2020/0352272 | A1 | 11/2020 | Jacobsen |
| 2020/0367596 | A1 | 11/2020 | Chilson et al. |
| 2020/0375297 | A1 | 12/2020 | Cleveland et al. |
| 2021/0045487 | A1 | 2/2021 | Weber et al. |
| 2021/0093034 | A1 | 4/2021 | Jacobsen |
| 2021/0106091 | A1 | 4/2021 | Glover et al. |
| 2021/0112898 | A1 | 4/2021 | Morgan |

FOREIGN PATENT DOCUMENTS

| | | |
|---|---|---|
| WO | WO9626654 | 9/1996 |
| WO | WO04006706 | 1/2004 |
| WO | WO06022680 | 3/2006 |
| WO | WO 2014-013464 | 1/2014 |
| WO | WO 2017-017654 | 2/2017 |
| WO | WO19084603 | 5/2019 |
| WO | WO2019/237025 | 12/2019 |
| WO | WO21043207 | 3/2021 |

OTHER PUBLICATIONS

Extended European Search Report for European Application No. 21803048.4 dated Aug. 22, 2024, 8 pages.

* cited by examiner

HARD HAT WITH IMPACT PROTECTION MATERIAL

CROSS-REFERENCE TO RELATED PATENT APPLICATION

The present application in a continuation of International Patent Application No. PCT/US2021/031810, filed on May 11, 2021, which claims the benefit of and priority to U.S. Provisional Application No. 63/023,516, filed on May 12, 2020, which are incorporated herein by reference in their entireties.

BACKGROUND OF THE INVENTION

The present invention relates generally to the field of protective equipment. The present invention relates specifically to various hard hat designs with a layer of impact protection material and to impact protection layer design for protective equipment.

Hard hats are often used in construction or other environments/worksites where head protection is warranted. For example, hard hats are used in environments where there is a risk for head injury and act to provide added protection to a worker's head.

SUMMARY OF THE INVENTION

One embodiment relates to a hard hat including an outer shell formed from a rigid material. The outer shell includes an exterior surface, an interior surface, a crown portion, a bottom portion, and an impact protection layer. The interior surface defines a cavity configured to receive a head of an operator. The crown portion is positioned in a central area of the hard hat surrounding a center point. The bottom portion defines a lower circumference extending along the exterior surface. The impact protection layer is positioned within the cavity and includes a first piece of impact absorbing material at a first location within the cavity and a second piece of impact absorbing material supported at a second location within the cavity. The first and second piece of impact absorbing materials are formed from a material. The material has a non-uniform stiffness such that each piece has a first compression axis having a first stiffness and a second compression axis having a second stiffness. The first stiffness is greater than the second stiffness.

Another embodiment relates to a hard hat including an outer shell formed from a rigid material. The outer shell includes an exterior surface, an interior surface, a crown portion, a brim portion, and an impact protection layer. The interior surface defines a cavity configured to receive a head of an operator. The crown portion is positioned in a central area of the hard hat surrounding a center point. The brim portion defines a lower circumference extending along the exterior surface. The impact protection layer is positioned within the cavity and includes a first piece of impact absorbing material at a first location within the cavity and a second piece of impact absorbing material supported at a second location within the cavity. The first and second piece of impact absorbing materials are formed from a material. The material has a non-uniform stiffness such that each piece has a first compression axis having a first stiffness and a second compression axis having a second stiffness. The first stiffness is greater than the second stiffness and the first compression axes of the first and second pieces of impact absorbing material are nonparallel to each other.

Another embodiment relates to a hard hat including a hard hat including an outer shell formed from a rigid material. The outer shell includes an exterior surface, an interior surface, a crown portion, a bottom portion, an impact protection layer, and an attachment structure. The interior surface defines a cavity configured to receive a head of an operator. The crown portion is positioned in a central area of the hard hat surrounding a center point. The bottom portion defines a lower circumference extending along the exterior surface. The impact protection layer is positioned within the cavity. The attachment structure non-rigidly supports the impact protection layer adjacent to the interior surface of the outer shell such that the impact protection layer is allowed to move relative to the outer shell while being retained adjacent to the interior surface.

Another embodiment of the invention relates to a helmet or hard hat. The hard hat includes an outer shell formed from a rigid material and includes an external surface and an internal surface that defines a cavity sized to receive the head of a wearer. The hard hat includes an impact protection layer located within the cavity. The impact protection includes a first piece of impact energy absorbing material supported at a first location within the cavity and a second piece of impact energy absorbing material supported at a second location within the cavity. The first piece of impact energy absorbing material is distinct and separate from the second piece.

In various embodiments, the first and second piece of impact absorbing material are formed from the same type of material as each other. In some such embodiments, the impact absorbing material is a material that has non-uniform stiffness such that each piece has a first compression axis having a first stiffness and a second compression axis having a second stiffness, and the first stiffness is greater than the second stiffness. In one embodiment, the first stiffness is at least twice the second stiffness. In one embodiment, the first stiffness is at least six times the second stiffness, and in another embodiment, the third stiffness is at least eight times the second stiffness.

In some embodiments, the first and second pieces are positioned within the outer shell such that first compression axes of the first and second piece are nonparallel to each other. In some such embodiments, the first and second pieces are positioned within the outer shell such that first compression axes of the first and second pieces are aligned in a radial direction and the second compression axes of the first and second pieces are aligned in the circumferential direction around the internal surface of the outer shell.

In various embodiments, the first and second pieces are supported within the outer shell adjacent the internal surface of the outer shell such that the pieces contact the internal surface of the outer shell. In various embodiments, the impact protection layer includes three or more pieces of impact absorbing material.

Another embodiment of the invention relates to a helmet or hard hat. The hard hat includes an outer shell formed from a rigid material and includes an external surface and internal surface that defines a cavity sized to receive the head of a wearer. The hard hat includes an impact protection layer located within the cavity. The hard hat includes an attachment structure that non-rigidly supports the impact protection layer adjacent to the internal surface of the outer shell while allowing for relative movement between the impact protection layer and the outer shell. In some such embodiments, the attachment structure is a retention rib that includes a central wall and a flange. The central wall extends inward from the inner surface of the outer shell and the flange that extends away from the central wall. The flange has an inner surface that overlaps a portion of an exterior surface of the impact protection layer to retain the impact protection layer within the outer shell. In a specific embodiment, the retention rib maintains the impact protection layer adjacent the inner surface of the hard hat shell without bonding with an adhesive.

Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments, and together with the description serve to explain principles and operation of the various embodiments.

DETAILED DESCRIPTION

Referring generally to the figures, various embodiments of a hard hat and/or impact protection layer are shown. As will be understood, hard hats typically include one or more layer of material that absorbs linear and/or rotational impact energy, such as padding or foam materials. In general, the hard hat designs discussed herein include one or more features to improve energy absorption by the impact protection layer during linear and/or rotational impacts.

In specific embodiments, the impact protection layers discussed herein include an auxetic energy absorbing material and/or an energy absorbing material with anisotropic stiffness properties. In such embodiments, Applicant has designed impact protection layers with segments of energy absorbing material that are positioned along the inside of the outer hard hat shell so that the material is aligned relative to the hard hat shell and relative to likely impacts to provide improved impact energy absorption by the material.

Further, in various embodiments, Applicant has developed various additional hard hat components that improve the support of the energy absorbing material within the outer hard hat shell. In particular, designs discussed herein, Applicant's hard hat designs allow for shifting and/or gliding of the impact absorbing layer along the inner surface of the outer hard hat shell which improves energy absorption during impact. In particular, embodiments of the Applicant's hard hat designs discussed herein provide for support and retention of the energy-absorbing layer without use of rigid supports or rigid adhesives that may limit gliding of the impact-absorbing layer within the hard hat shell.

Figure 1:
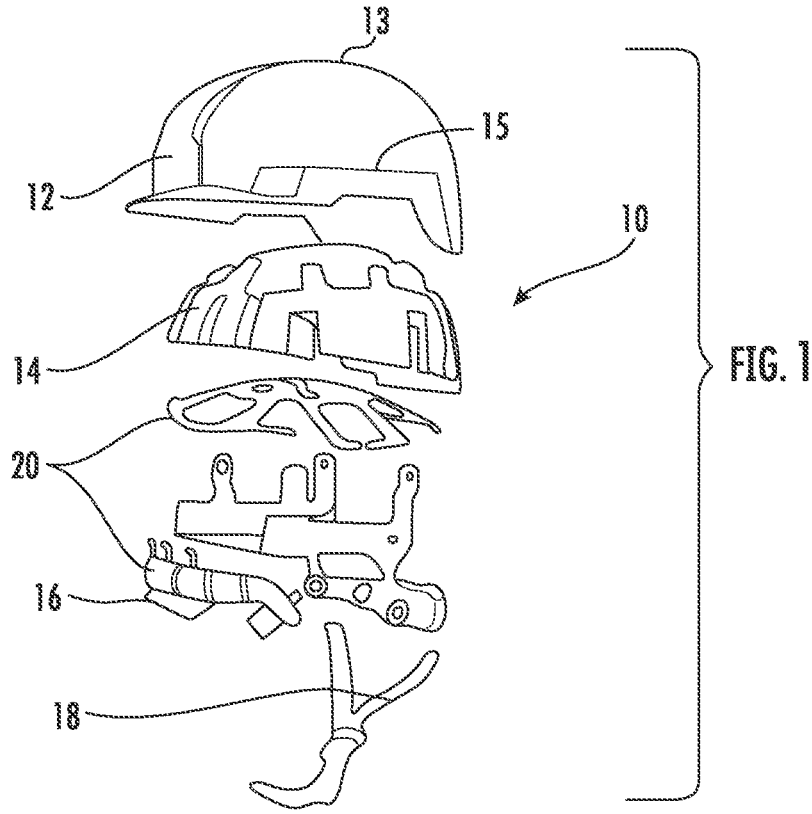
FIG. 1 is an exploded view of a hard hat, according to an exemplary embodiment.

Referring to FIG. 1, an exploded view of a hard hat 10 is shown according to an exemplary embodiment. Hard hat 10 includes an outer shell 12 formed from a rigid material, such as a rigid polymer material. Outer shell 12 includes a crown portion 13 and a bottom or brim portion 15 defining a lower circumference of hard hat 10. Hard hat 10 includes an impact protection layer 14 supported within outer shell 12. Details of the various embodiments of impact protection layer 14 and support within outer shell 12 are discussed in more detail below. Hard hat 10 includes a suspension system 16 and a chin strap 18 to support and secure hard hat 10 to a user's head. Hard hat 10 also includes various layers of padding 20 to provide increased comfort to the wearer.

Figure 2:
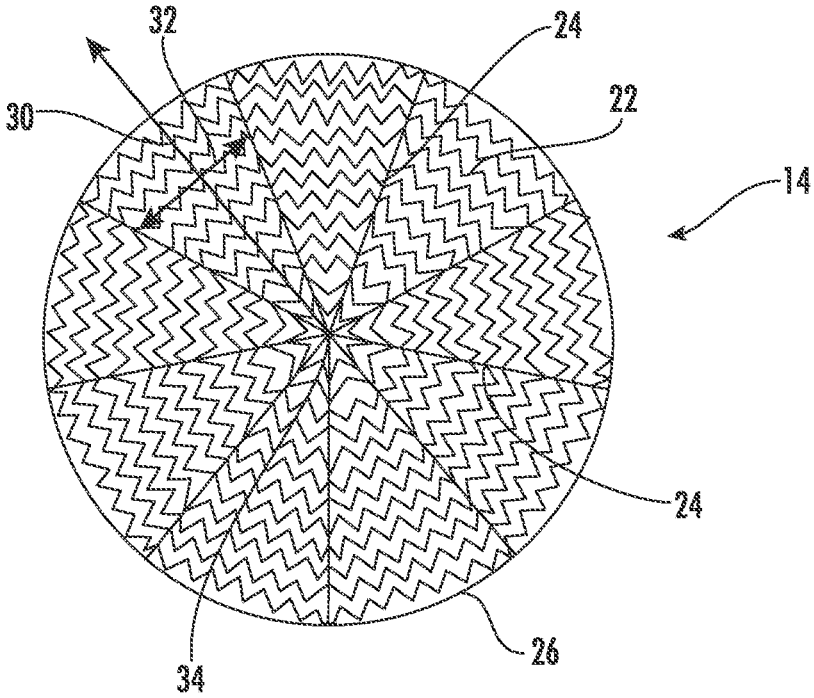
FIG. 2 is a plan view of an impact protection layer, according to an exemplary embodiment.

FIG. 2 shows a plan view of impact protection layer 14 located within the inner surface of outer shell 12 of hard hat 10. As shown, impact protection layer 14 is formed from a plurality of sections 22 of an impact energy absorbing material. As will be discussed in more detail below, sections 22 of an impact energy absorbing material are supported from outer shell 12 in the radial direction by ribs 24 and around the outer perimeter/circumference (e.g., adjacent a brim of the hard hat) by retention ring 26.

In general, each section 22 is formed from a material that is designed to absorb linear impact energy and/or rotational impact energy. As such, the material of each section 22 is designed to reduce the acceleration (linear or rotational) of the head during an impact event and reduce the impact forces that may otherwise be transmitted to the head.

In specific embodiments, the material of each section 22 is formed from a material with anisotropic stiffness/compression properties along two or more orthogonal axes of the material. In the specific embodiment shown in FIG. 2, the material of each section 22 has a compression axis with the greater stiffness 30 and a compression axis with lower stiffness 32. In general, the stiffness along compression axis 30 is at least twice that of the stiffness along compression axis 32. In more specific embodiments, the stiffness along compression axis 30 is at least three times, specifically at least six times and more specifically at least eight times, that of the stiffness along compression axis 32.

Sections 22 are positioned such that the more stiff compression axis 30 of each section 22 is aligned in the radial direction, and the less stiff compression axis 32 is aligned in the circumferential direction. In this positioning, compression axis with the greater stiffness 30 of each section 22 is aligned in a direction extending from center point 34 toward outer retention ring 26, and less stiff compression axis 32 of each section 22 is aligned generally in a direction extending between ribs 24. As will be generally understood, the compression axis with the greater stiffness 30 absorbs higher levels of impact energy absorption as compared to the less stiff compression axis 32. Thus, Applicant believes that by segmenting an anisotropic compression material to form impact protection layer 14 with the stiff compression axis aligned radially as shown in FIG. 2, improved impact performance can be provided around the entire circumference of hard hat 10, as compared to a helmet with a single sheet of anisotropic stiffness, energy absorbing material.

In particular, Applicant believes that the segmented and aligned arrangement of the sections of impact protection layer 14 provides for specific improvement in impact resistance in the field of helmets and particularly of hard hats. For example, most energy absorbing materials that may be used in helmet/hard hat applications do not readily bend and flex to fit into the tight curves of many helmet interiors. Thus, Applicant has found that this inflexibility makes it difficult to shape and position a single piece of energy absorbing material within the helmet shell in a way that improves impact performance since there are limits on how the material can be fit into the helmet shell. Thus, Applicant believes that by forming impact protection layer 14 from separate smaller pieces of energy absorbing material aligned as discussed herein, improved impact performance can be provided along with allowing for utilization of impact resistant materials previously believed to be too rigid and inflexible for use in hard hat applications.

As shown in FIG. 2, impact protection layer 14 is formed from multiple and discrete pieces or sections 22 of impact absorbing materials. In the specific embodiments, impact protection layer includes three or more sections 22. In even more specific embodiments, impact protection layer 14 is formed from 4, 5, 6, 7, 8, 9, 10, 15, 20, etc. separate sections 22.

As shown in FIG. 2, sections 22 are shaped such that compression axis with the greater stiffness 30 is aligned in the direction of the long or major axis of each section 22 and the less stiff compression axis 32 is aligned in the direction of the short or minor axis of each section 22. Then, when assembled in to impact protection layer 14 within outer shell 12, the major axes of sections 22 are aligned in a direction generally extending from the center 34 of the helmet toward the outer perimeter or bottom portion 15 of the helmet with the minor axis generally extending in the circumferential direction around the cavity that receives the user's head.

In the particular embodiment shown in FIG. 2, sections 22 have a tapered or triangular shape such that the width (e.g., the dimension that aligns with less stiff axis 32) increases in the direction along the radial axis toward the outer perimeter or bottom portion 15 of shell 12 and/or toward outer retention ring 26. Further, in this specific embodiment, each section 22 has the same shape as the other sections. In other embodiments, sections 22 may have a different tapered shape (e.g., various different tapered shapes) from each other. In some such embodiments, the different tapered shapes of each section 22 may provide for different positioning and/or shaping within hard hat 10. In general, Applicant believes that the tapered shape of sections 22 and along with the radially extending arrangement around the center point 34 of the hard hat improves the alignment of compression axis with the greater stiffness 30 in the direction of likely impact, thereby improving the impact performance of hard hat 10, as compared to designs that utilize a single piece of impact energy absorbing materials.

In one embodiment, each section 22 is formed from a sheet of material that has different compression stiffnesses in all three orthogonal axis providing deformation characteristics in each compression axis that absorbs impact energy. It should be understood that, while auxetic and anisotropic materials are specifically discussed herein, a variety of other types of impact absorbing materials can be utilized with the various hard hat and impact protection layer designs discussed herein.

Figure 3:
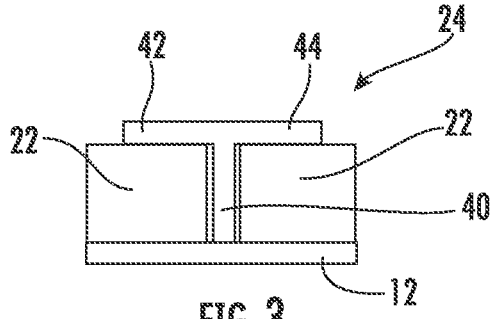
FIG. 3 shows a separation rib supporting sections of an impact protection layer within the outer shell of a hard hat, according to an exemplary embodiment.

Referring to FIG. 3, a detailed sectional view of one of the separation ribs 24 supporting sections 22 of impact absorbing material is shown according to an exemplary embodiment. In general, separation rib 24 is a retention structure that is coupled to outer shell 12 and is shaped to capture and retain sections 22 in position relative to outer shell 12. In general, separation rib 24 is structured and coupled to outer shell 12 in a manner that will allow for deformation and gliding of sections 22 within outer shell 12 during impact. Applicant believes that by utilizing flexible ribs, such as ribs 24, to support discrete sections of impact absorbing material within the helmet shell, a wider variety of energy absorbing materials can be integrated into the helmet and optimized for their location inside of the helmet.

In general, conventional construction helmets/hard hats utilize a single piece of foam impact material located within the outer hard hat shell, and Applicant understands that the leading method that construction helmets employ to secure foam to the interior is the use of adhesives that bond the foam material directly to the outer shell. Applicant has identified that this rigid adhesive approach to attaching the foam material provides no additional impact protection while also rigidly holding the foam in place. In various embodiments discussed herein, attachment of the impact absorbing material is provided without use of a rigid connection. Connection in this manner allows for motion of the energy absorbing material relative to the shell, which allows for additional impact absorption, particularly rotational impact energy absorption.

In addition to support layer 14 within hard hat outer shell 12, separation ribs 24 may be designed to provide radial impact absorption in addition to that provided by layer 14. In particular, ribs 24 are formed from a low durometer material (such as a low durometer rubber, foam and/or plastic material) that deforms to absorb impact. This deformation allows for gliding of sections 22 during impact, which improves impact performance of some materials. Further, ribs 24 are coupled to outer shell 12 via an attachment structure, such as a screw, adhesive, snap feature, over-molding, etc. The attachment structure is configured and/or positioned so to not inhibit movement of sections 22 during impact and thereby improves impact performance of sections 22.

As shown in FIG. 3, each rib 24 includes a central wall 40. Central wall 40 extends inward (e.g., toward the user's head when worn) and away from the inner surface of outer shell 12. In addition, central wall 40 is located in a space located between adjacent sections 22. Each rib 24 includes a first flange 42 and a second flange 44. As shown in FIG. 3, first flange 42 extends a first direction (left in the orientation of FIG. 3) from central wall 40, and second flange 44 extends a second direction (right in the orientation of FIG. 3) from central wall 40. Both flanges 42 and 44 overlap sections 22 of impact absorbing material such that contact between an inner surface of the flanges and outer surfaces of sections 22 allow for ribs 24 to retain sections 22 relative flush along the inner surface of outer shell 12.

In the specific embodiment of ribs 24 shown in FIG. 3, flanges 42 and 44 are substantially planar structures that extend at a substantially right angle from central wall 40. In this embodiment, the height of central wall 40 is approximately the same as the thickness of sections 22, which provides for a relatively small gap between flanges 42 and 44 and sections 22.

Figure 4:
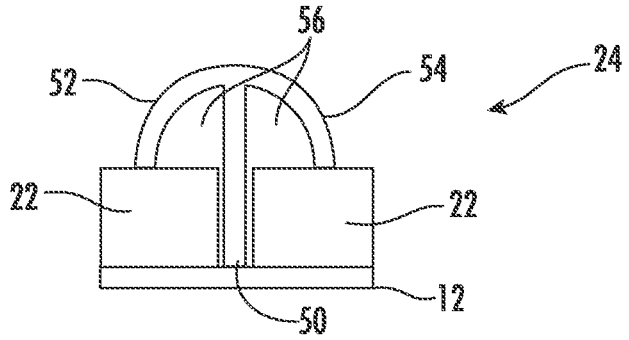
FIG. 4 shows a separation rib supporting sections of an impact protection layer within the outer shell of a hard hat, according to another exemplary embodiment.
Figure 5:
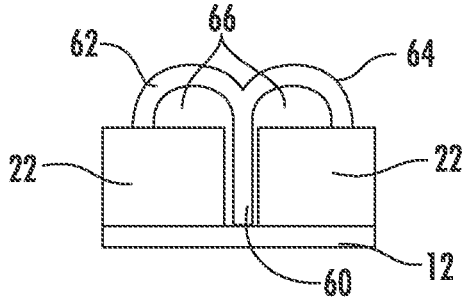
FIG. 5 shows a separation rib supporting sections of an impact protection layer within the outer shell of a hard hat, according to another exemplary embodiment.
Figure 6:
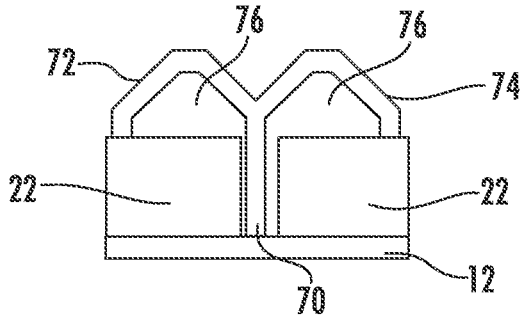
FIG. 6 shows a separation rib supporting sections of an impact protection layer within the outer shell of a hard hat, according to another exemplary embodiment.

Referring to FIGS. 4-6, additional designs for separation ribs 24 are shown. In general, the separation rib designs in FIGS. 4-6 are further designed or shaped to provide additional impact absorption. In general, the separation rib designs shown in FIGS. 4-6 are substantially the same as the separation rib shown in FIG. 3, except for the differences discussed herein.

Referring to FIG. 4, in one embodiment, separation rib 24 includes a central wall 50 that has a height that is greater (e.g., at least 20% greater, at least 50% greater) than the thicknesses of sections 22. Curved flanges 52 and 54 extend outward from either side of the outer end of wall 50. In the embodiment shown, curved flanges 52 and 54 form a semi-circular shape bisected by wall 50. In this design, gaps 56 are defined between the inner surfaces of flanges 52 and 54 and an outer surface of sections 22 providing for an additional crumple zone for increased impact absorption.

Referring to FIG. 5, in another embodiment, separation rib 24 includes a central wall 60 and arch-shaped flanges 62 and 64 that extend from either side of the outer end of wall 60. In the embodiment shown, arch-shaped flanges 62 and 64 are each rounded arches having a generally semi-circular shape. Gaps 66 are defined between the inner surfaces of flanges 62 and 64. Similar to the design shown in FIG. 4, gaps 66 provide for an additional crumple zone for increased impact absorption.

Referring to FIG. 6, in another embodiment, separation rib 24 includes a central wall 70 and arch-shaped flanges 72 and 74 that extend from either side of the outer end of wall 70. In the embodiment shown, arch-shaped flanges 72 and 74 have a partial polygonal (specifically a partial octagonal) shape, and gaps 76 are defined between the inner surfaces of flanges 72 and 74. Similar to the design shown in FIG. 4, gaps 76 provide for an additional crumple zone for increased impact absorption.

Figure 7:
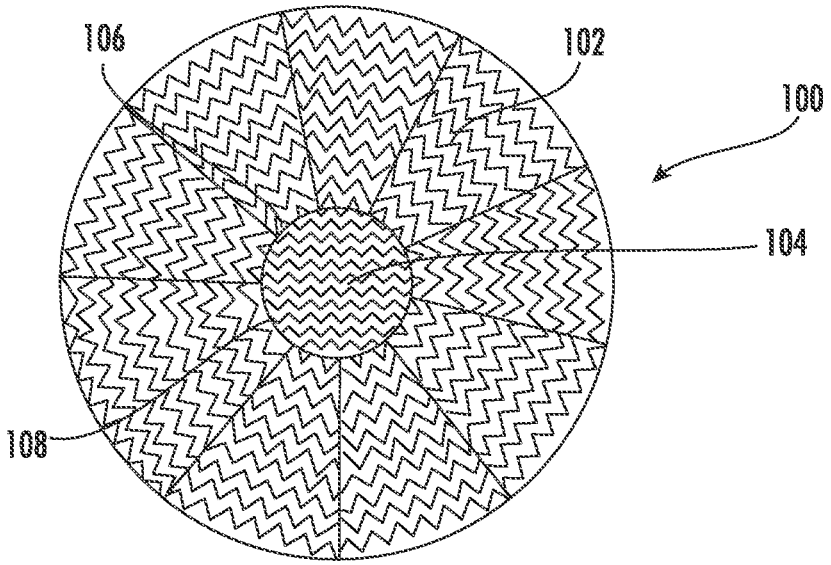
FIG. 7 is a plan view of an impact protection layer, according to another exemplary embodiment.

Referring to FIG. 7, an impact protection layer 100 is shown according to an exemplary embodiment. Impact protection layer 100 is substantially the same as impact protection layer 14 except for the differences discussed herein. Impact protection layer 100 includes multiple radially aligned sections 102 of impact energy absorbing material, similar to sections 22, and a central section 104 of impact absorbing material. In this embodiment, central section 104 is positioned along the inner surface of the crown portion 13 of the outer shell 12 of hard hat 10. Central section 104 is a piece of impact absorbing material having greater compression stiffness axis 30 positioned to absorb a linear top impact to the top of the helmet. The radially aligned sections 102 are positioned to provide oblique impact performance similar to radial sections 22 discussed above.

Sections 102 have a tapered shape similar to sections 22. However, rather than tapering to a relatively narrow point, sections 102 have curved inner edges 106 that are shaped to conform around the perimeter of central section 104.

In addition, to accommodate and retain central section 104, a circular separation rib 108 is attached along the inner surface of the outer shell of the hard hat utilizing protection layer 100. Circular separation rib 108 surrounds the outer perimeter of central section 104. Circular separation rib 108 may be configured as any of the retention rib designs discussed herein.

Figure 8:
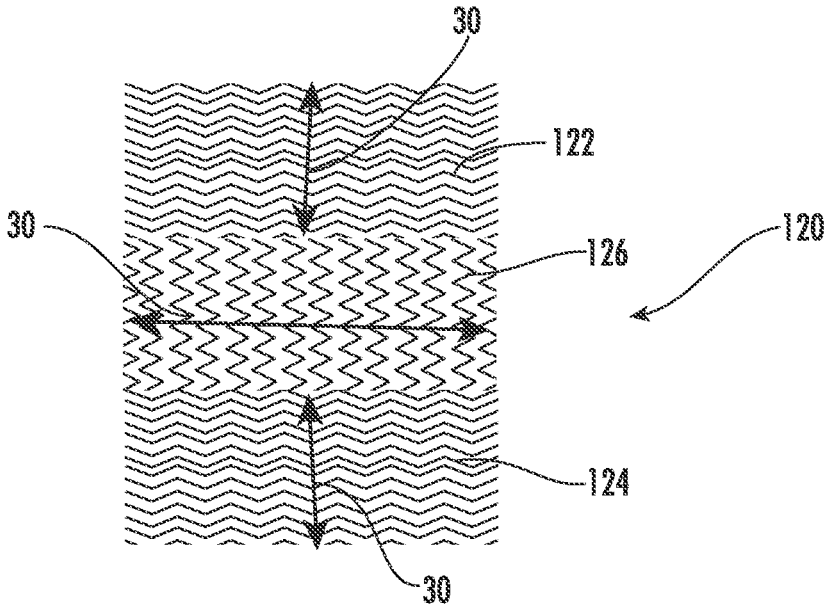
FIG. 8 is a plan view of an impact protection layer, according to another exemplary embodiment.

Referring to FIG. 8, an impact protection layer 120 is shown according to an exemplary embodiment. Impact protection layer 120 is substantially the same as impact protection layer 14 except for the differences discussed herein. Impact protection layer 120 includes a plurality of sections 122, 124 and 126. In general, sections 122, 124 and 126 are rectangular sections that are arranged such that the orientation of the compression axis with the greater stiffness 30 within each section is different from the orientation of the compression axis with the greater stiffness 30 of at least one adjacent section. In a specific embodiment, sections 122, 124 and 126 are sections that are arranged such that the orientation of the compression axis with the greater stiffness 30 within each section 122, 124 and 126 is orthogonal to the orientation of the compression axis with the greater stiffness 30 of at least one adjacent section.

As shown in FIG. 8, front section 122 and rear section 124 are aligned such that the compression axis with the greater stiffness 30 of each is aligned front to back, and the center section 126 has the compression axis with the greater stiffness 30 aligned side to side. This arrangement is believed to provide improved rotational impact performance in direct front, rear, and side impact directions as compared to a design utilizing a single piece of impact resistant material. In addition, impact protection layer 120 provides a dual compliance behavior, due to the aligned compression axes of the front section 122 and rear sections 124, when compressed front to back which may improve rotational impact performance.

Figure 9:
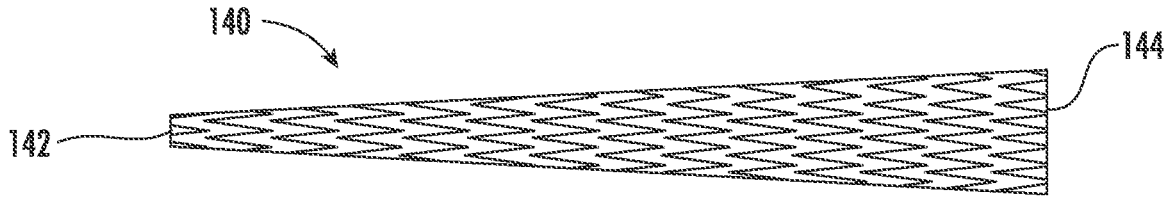
FIG. 9 is a cross-sectional view of a section of impact energy absorbing material for an impact protection layer, according to an exemplary embodiment.

Referring to FIG. 9, a cross-sectional view of a section 140 of impact absorbing material is shown according to an exemplary embodiment. Section 140 is substantially similar to section 22 and may be utilized in any of the impact protection layer designs discussed herein. As shown in FIG. 9, section 140 has a variable thickness. In the particular embodiment shown, section 140 has a lower thickness at the outer or brim edge 142 of section 140 and a greater thickness at the inner or crown edge 144. The crown portion 13 has a perimeter that defines crown edge 144. In the embodiment shown, section 140 has a tapered thickness that decreases in the direction from the crown edge 144 to the brim edge 142 along entire length of section 140. In other embodiments, a tapered shape may be approximated by forming section 140 from discrete subsections of variable thickness.

When section 140 is used in the embodiment shown in FIG. 3, the thick portions at crown edge 144 taper to the point shown adjacent center 34 in FIG. 3. When section 140 is used in the embodiment shown in FIG. 7, the thick portion at edge 144 is adjacent the central section 104, and in some such embodiments, central section 104 may have a thickness equal to or greater than the thickness at crown edge 144. When section 140 is used in the embodiment shown in FIG. 8, the front and rear sections 122 and 124 may be formed from tapered sections 140 with the thick portion at edge 144 located adjacent the central/crown section 126.

Without wishing to be bound by a particular theory, the variable thickness of tapered section 140 creates a progressive rate torsional spring that Applicant believes may increase rotational performance. In addition, use of tapered sections 140 also creates a lower profile impact protection layer adjacent brim of the hard hat while providing a thicker region of impact energy absorbing material at the crown of the hard hat. The reduced thickness at the brim provides a less bulky hard hat and the added thickness at the crown will increase top impact performance.

Figure 10:
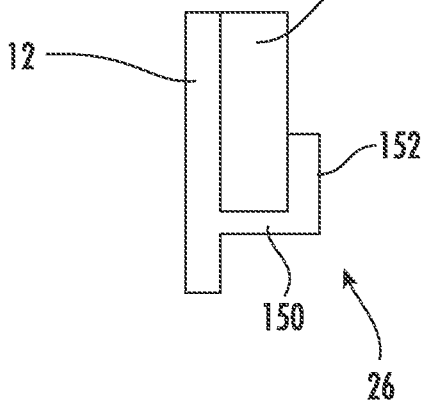
FIG. 10 shows a retention ring for an impact protection layer located on the inner circumference of a hard hat shell, according to an exemplary embodiment.

Referring to FIG. 10, a detailed view of perimeter or brim retention ring 26 is shown. In general, retention ring 26 is positioned near the outer perimeter or bottom portion 15 and defines a region that captures and engages sections 22 of impact energy absorbing material to hold the material in place within the outer shell of the helmet. In specific embodiments, this retention is accomplished via friction without use of adhesive. As shown in the specific embodiment of FIG. 10, retention ring 26 includes a wall 150 that extends radially inward from the inner surface of outer shell 12. A flange 152 extends away from wall 150 in a direction toward the crown portion 13 of the outer helmet shell. Flange 152 has an inner surface that engages the outer surface of a section 22 of impact protection material. In this embodiment, section 22 is retained in place along the inner surface of outer shell 12 without rigid attachment provided by adhesives or other rigid connection components.

In various embodiments, retention ring 26 can be made from a wide variety of materials having a variety of different stiffnesses as may be selected for different impact performance criteria. In some embodiments, retention ring 26 is made from materials having a wide range of stiffnesses, from stiff ABS to a soft low durometer rubber/silicone material.

Retention ring 26 can be attached to the shell 12 utilizing a variety attachment mechanisms, such as screws, adhesive, snap features, over-molding, etc. Further, ring 26 may also include one or more attachment point for other components of hard hat 10, including suspension system 16 and/or chin strap 18 shown in FIG. 1.

Figure 11:
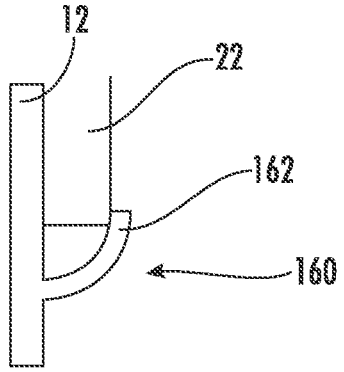
FIG. 11 shows a retention ring for an impact protection layer located on the inner circumference of a hard hat shell, according to another exemplary embodiment.

Referring to FIG. 11, a retention ring 160 is shown according to an exemplary embodiment. Retention ring 160 is substantially the same as retention ring 26 except for the differences discussed herein. Retention ring 160 is an arch-shaped rim extending from the inner surface of shell 12. Similar to the design shown in FIG. 10, ring 160 includes an end region 162 that engages and retains section 22 along the inner surface of shell 12, and in specific embodiments, this retention is accomplished without use of adhesives.

Figure 12:
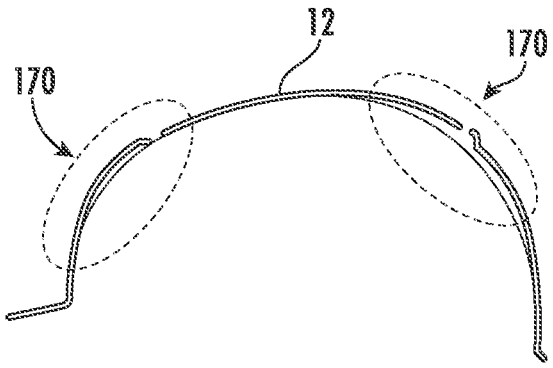
FIG. 12 shows the cross-sectional profile of a hard hat outer shell illustrating regions that may impede gliding of an impact protection layer, according to an exemplary embodiment.
Figure 13:
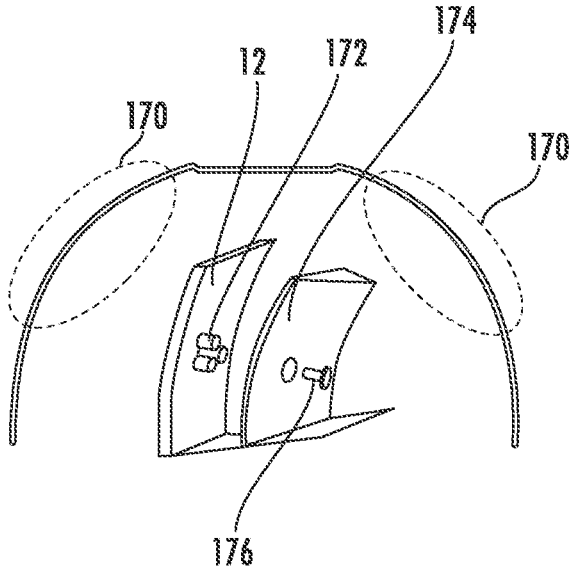
FIG. 13 shows secondary components that attach to a hard hat shell that improve gliding of impact protection layer along the inner surface of the outer shell, according to an exemplary embodiment.

Referring to FIGS. 12 and 13, a design for further improving the impact performance of hard hat 10 is shown and described. As noted above, some materials used to form impact protection layers provide better impact resistance when permitted to slide, glide or shift during an impact event. Further, as shown in FIG. 12, in at least some hard hat designs, outer shell 12 may include a variety of points shown in regions 170 that have sharp edges, protrusions, recesses, etc. that Applicant believes may inhibit the ability of some impact absorbing material to slide, glide or shift within the hard hat shell, which reduces the efficacy of the impact energy absorption provided by the protection layer.

As shown in FIG. 13, in some embodiments, outer hard hat shell 12 includes attachment structures 172 located within or adjacent to regions 170. In such embodiments, hard hat 10 includes one or more geometry-altering secondary component 174 that is coupled along the inner surface of hard hat shell via a fastener 176 to attachment point 172. Attachment structures 172 may be a variety of coupling structures including snap features, screw bosses, etc.

Secondary component 174 is positioned within hard hat shell 12 and between hard hat shell 12 and protection layer 14. Secondary component 174 is shaped to engage along the inner surface of hard hat shell 12 in a manner that covers, blocks, or otherwise reduces the ability of the material of impact protection layer 14 from becoming caught within region 170 during an impact event. Thus, an inner surface of secondary component 174 provides for the alteration of the inner geometry hard hat shell 12 to provide an inner geometry (e.g. rounded inner surface) that is more conducive to the gliding motion of the impact protection material, and in this manner improve the impact protection provided by hard hat 10.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the invention relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

What is claimed is:

1. A hard hat, comprising:

an outer shell formed from a rigid material, the outer shell comprising:

an exterior surface;

an interior surface defining a cavity configured to receive a head of an operator;

a crown portion positioned in a central area of the hard hat surrounding a center point;

a bottom portion defining a lower circumference extending along the exterior surface;

an impact protection layer positioned within the cavity, the impact protection layer comprising:

a first piece supported at a first location within the cavity; and a second piece supported at a second location within the cavity; and an attachment structure that non-rigidly supports the impact protection layer within the cavity; and separation ribs coupled to the outer shell, the separation ribs including:

a central wall positioned between adjacent pieces of the impact protection layer;

a first flange extending in a first direction from the central wall; and a second flange extending in a second direction from the central wall;

wherein the first flange overlaps at least a portion of the first piece of the impact protection layer and second flange overlaps at least a portion of the second piece of the impact protection layer such that the first and second pieces of the impact protection layer are retained relative to the interior surface of the outer shell.

2. The hard hat of claim 1, wherein a major axis of each piece of the impact protection layer generally extends from the center point toward the bottom portion of the outer shell and a minor axis of each piece of the impact protection layer generally extends in a circumferential direction around the cavity of the outer shell.

3. The hard hat of claim 2, wherein the first and second pieces of the impact protection layer have a tapered or triangular shape such that a width extending in a direction of the minor axis increases along the major axis in a direction toward the bottom portion of the outer shell.

4. The hard hat of claim 1, wherein a height of the central wall is approximately the same as a thickness of the first and second pieces of the impact protection layer, and wherein first and second flanges are substantially planar structures extending at a substantially right angle from the central wall.

5. The hard hat of claim 1, wherein the central wall includes a height greater than a thickness of the impact protection layer, and wherein the first flange includes an inner surface and the second flange includes an inner surface, the first and second flange defining a pair of gaps between the inner surface of the first and second flanges and an outer surface of the impact protection layer.

6. The hard hat of claim 1, further comprising a retention ring coupled to the outer shell via an attachment mechanism and positioned at the bottom portion of the outer shell along the interior surface, the retention ring comprising:

a wall extending radially inward from the outer shell; and a flange extending from the wall in a direction toward the crown portion of the outer shell;

wherein an inner surface of the flange engages an outer surface of the impact protection layer such that the impact protection layer is retained along the interior surface of the outer shell without rigid attachment.

7. A hard hat, comprising:

an outer shell formed from a rigid material, the outer shell comprising:

an exterior surface;

an interior surface defining a cavity configured to receive a head of an operator;

a crown portion positioned in a central area of the hard hat surrounding a center point;

a brim portion defining a lower circumference extending along the exterior surface;

an impact protection layer positioned within the cavity, the impact protection layer comprising:

a first piece supported at a first location within the cavity; and a second piece supported at a second location within the cavity; and an attachment structure that non-rigidly supports the impact protection layer within the outer shell, wherein the attachment structure supports the impact protection layer adjacent to the interior surface of the outer shell allowing the impact protection layer to shift relative to the outer shell; and a secondary component coupled along the interior surface of the outer shell via a fastener to the attachment structure, wherein the secondary component is positioned between the outer shell and the impact protection layer and engages the impact protection layer, wherein an inner surface of the secondary component is rounded such that the impact protection layer is allowed to slide along the inner surface of the secondary component.

8. The hard hat of claim 7, further comprising separation ribs coupled to the outer shell, the separation ribs including:

a central wall positioned between adjacent pieces of the impact protection layer;

a first flange extending in a first direction from the central wall; and a second flange extending in a second direction from the central wall;

wherein the first flange overlaps at least a portion of the first piece of the impact protection layer and second flange overlaps at least a portion of the second piece of the impact protection layer such that the first and second pieces of the impact protection layer are retained relative to the outer shell.

9. A hard hat, comprising:

an outer shell formed from a rigid material, the outer shell comprising:

an exterior surface;

an interior surface defining a cavity configured to receive a head of an operator;

a crown portion positioned in a central area of the hard hat surrounding a center point;

a bottom portion defining a lower circumference extending along the exterior surface;

an impact protection layer positioned within the cavity; and an attachment structure that non-rigidly supports the impact protection layer adjacent to the interior surface of the outer shell such that the impact protection layer is allowed to move relative to the outer shell while being retained adjacent to the interior surface;

wherein the impact protection layer includes a central section positioned along the interior surface of the crown portion and a plurality of radially aligned sections extending outward from the central section, the radially aligned sections including a curved inner edge; and wherein a circular crown perimeter defines a circumference along the exterior surface of the outer shell and the plurality of radially aligned sections of the impact protection layer have a variable thickness such that the plurality of radially aligned sections include a thicker portion at the crown perimeter adjacent the crown portion and decreasing thickness in a direction from the crown perimeter to a brim edge positioned at the bottom portion of the hard hat.

10. The hard hat of claim 9, wherein the impact protection layer includes a plurality of sections.

11. The hard hat of claim 9, wherein the attachment structure further includes a circular separation rib surrounding an outer perimeter of a central section of the impact protection layer.

12. The hard hat of claim 9, wherein the attachment structure is a retention rib, the retention rib including a central wall and a flange, the central wall extending inward from the interior surface of the outer shell and the flange extending away from the central wall.

* * * * *